US006425635B1

(12) United States Patent
Pulver

(10) Patent No.: US 6,425,635 B1
(45) Date of Patent: Jul. 30, 2002

(54) WEIGHT-SHIFTING RECLINING AND TILTING WHEELCHAIR SEAT

(75) Inventor: Dale Pulver, University Heights, OH (US)

(73) Assignee: Invacare Corporation, Elyra, OH (US)

( * ) Notice: Subject to any disclaimer, the term of this patent is extended or adjusted under 35 U.S.C. 154(b) by 0 days.

(21) Appl. No.: 09/432,483

(22) Filed: Nov. 1, 1999

(51) Int. Cl.[7] ..... A61G 15/00

(52) U.S. Cl. ..... 297/343; 297/325; 297/330; 297/DIG. 4

(58) Field of Search ..... 297/354.12, 362.12, 297/362.13, 341, 342, 343, 362, 330, DIG. 4, 325, 329; 280/250.1

(56) References Cited

U.S. PATENT DOCUMENTS 349,063 A * 9/1886 Shepard
2,497,395 A * 2/1950 Cramer, Sr.
3,111,181 A * 11/1963 Yatich
3,580,635 A * 5/1971 Posh
4,153,292 A * 5/1979 White et al.
4,333,681 A * 6/1982 Nelson
4,544,200 A * 10/1985 Dunn et al.
4,632,450 A * 12/1986 Holdt
4,937,900 A * 7/1990 Bridges
5,044,647 A * 9/1991 Patterson
5,263,768 A * 11/1993 Scheulderman
5,297,021 A 3/1994 Koerlin et al.
5,356,172 A * 10/1994 Levy et al.
5,556,157 A * 9/1996 Wempe
5,785,384 A 7/1998 Sagstuen
5,868,461 A * 2/1999 Brotherston
5,971,482 A 10/1999 Goertzem et al.
6,059,370 A * 5/2000 Kanyer et al.

FOREIGN PATENT DOCUMENTS

EP 0 463 652 A1 2/1992

* cited by examiner

*Primary Examiner*—Milton Nelson, Jr.
(74) *Attorney, Agent, or Firm*—Hudak & Shunk Co., L.P.A.; Laura R. Shunk

(57) ABSTRACT

A wheelchair is provided, having a recline mechanism for the chair back and wherein the seat is repositioned forward in response to recline to reposition the user's weight relative to the supporting wheels. The chair is also independently equipped with a weight-shifting tilt mechanism. Moreover, a bilateral tracking mechanism (i.e., controlled motion is transmitted to both sides) is used to reposition the seat. This avoids torque due to uneven loading of the chair. Back canes of the chair and/or brackets on the chair back are slotted to enable infinite adjustment of chair arms, ventilator trays, and other accessories.

12 Claims, 9 Drawing Sheets

WEIGHT-SHIFTING RECLINING AND TILTING WHEELCHAIR SEAT

FIELD OF THE INVENTION

The invention relates to wheelchair seats, and in particular to a reclining and tilting wheelchair seat. The invention also relates to a reclining and tilting wheelchair seat having weight-shifting capability for maintaining the stability of an occupied chair during these repositioning actions. This is accomplished by minimizing the change in the center of gravity of the occupant of the wheelchair relative to the wheelchair supporting chassis. Further, the wheelchair utilizes a bilateral linkage with a single linear actuator to synchronize the forward movement of the seat relative to the base during recline in order to achieve weight-shift. This linkage also keeps the back from torquing in response to uneven loading. Further, the wheelchair has both weight-shift recline and weight-shift tilt features. Wheelchair canes are provided which permit infinite height adjustment for accessories by providing a longitudinal mounting slot.

BACKGROUND OF THE INVENTION

The market for wheelchairs is constantly changing. As the average age of the world's population continues to increase due to advances in health care, so does the need for health care appliances such as wheelchairs to serve an aging population. Further, the health care industry constantly strives to address the needs of individuals disabled by trauma and illness. While some wheelchair users may have their needs met by basic, manually operated chairs, many other wheelchair users require chairs with increasing numbers of features including electrical locomotion, shock absorption, and more comfortable seating.

Advances in seating have included features such as upholstered seats, tilting seats and reclining seats. However, features such as tilting and reclining seats, while desirable, can also be problematic. More specifically, when the seat of an occupied wheelchair is tilted or reclined, the center of gravity of the occupant of the chair relative to the wheelchair supporting chassis changes. In many cases the occupant is unable to reposition himself or herself so as to compensate for these changes. Although prior art wheelchairs have addressed the problem of changing center of gravity for a tilting-seat, similar problems associated with reclining seats have proven more difficult to overcome.

Prior art wheelchairs have attempted to solve the changing center of gravity problem upon seat recline, primarily in one of two ways. One common way to attempt to solve this problem has been to locate the wheelchair seat forward relative to the chassis of the chair. Thus, when the occupied seat is reclined by the occupant, the risk of the entire wheelchair overturning in a rearward direction is minimized. However, locating the seat toward the front of the wheelchair places too much weight on the front casters of the chair, thereby lowering the efficiency of the wheelchair motor and making it more difficult to maneuver.

An alternate prior art mode of solving the foregoing problem has been to increase the front-to-back length of the supporting chassis of the wheelchair, and locating the seat generally in the center of that chassis. Such a structure overcomes both problems associated with locating the chair toward the front of the wheelchair chassis as described immediately above. That is, the front casters of the wheelchair are free of undue loading, and upon recline of the chair seat the rear portion of the elongated chassis prevents rearward tipping of the chair. However, such a solution causes other problems. More particularly, providing an elongated chassis on the wheelchair adds unwanted weight and expense to the chair. Moreover, the elongated chassis, due to its added weight, requires more powerful and expensive motors to move the chair. Also, such an elongated chassis causes some loss of maneuverability of the wheelchair, such as in tight spots like an entryway, when compared to wheelchairs having a more compact chassis.

SUMMARY OF THE INVENTION

Objectives of the present invention include providing a reclining seat for a wheelchair, in which the center of gravity of the occupant of the chair shifts in a frontward direction relative to the chassis of the chair to maintain the stability of the wheelchair chair as the seat reclines. The invention relates to "weight shift" which is used herein to mean the repositioning of the chair members in order to maintain a relatively constant center of gravity of a hypothetical chair occupant and in turn to maintain the stability of the chair. The object of maintaining the stability of the wheelchair upon recline is met by providing a mechanism for shifting the chair seat forward in response to a backward recline of the seat back. More specifically, a curved link is provided which is connected to the back portion of the seat back and which retracts the seat back about an axis offset vertically upward from the rearward bottom edge of the seat cushion. A single linear actuator acts upon a lateral tie bar extending across the length of the seat and includes a toothed gear which engages a rack below the seat cushion to bilaterally transmit the motion of the actuator to both lateral edges of the seat cushion during the forward shifting. This bilateral effect inhibits torque which could result from uneven loading while minimizing the expense of the actuator.

Another objective of the present invention is to provide such a reclining seat for a wheelchair, in which the seat can optionally be capable of tilting. The tilting aspect is also provided with weight-shift capabilities in order to maintain the center of gravity of the occupant of the chair with regard to the supporting chassis.

This is accomplished by shifting the seat forward as the seat back and seat bottom are tilted relative to the supporting chassis. It is within the scope of the invention to provide for a rearward and/or sideways shifting of the seat relative to the chassis if this is necessary to maintain the stability of the chair. Further, the weight-shifting, tilt option is provided along, but independent of, a weight-shift, recline option.

An additional object of the invention is to provide stiffer wheelchair canes having a longitudinal slot which give the ability to mount accessories such as a ventilator tray or handles with infinite height adjustment while eliminating traditional double half clamps.

A further objective of the present invention is to provide a reclining seat for a wheelchair, which is relatively inexpensive to manufacture and maintain, relatively lightweight, and durable and reliable in use.

These objectives and advantages are obtained by the weight-shifting reclining wheelchair seat of the present invention, the general nature of which may be stated as including a reclinable back which desirably includes a back-shear feature; and a seat base frame which is projected forward an appropriate amount as the seat back is reclined. The recline mechanism may include a power actuator and a controller having a user interface. Further, the chair may include an independent seat tilt mechanism which preferably also includes a weight shift feature so as to stabilize the wheelchair during use.

BRIEF DESCRIPTION OF THE DRAWINGS

The preferred embodiment of the invention, illustrative of the best mode in which applicants have contemplated applying the principles, is set forth in the following description and is shown in the drawings and is particularly and distinctly pointed out and set forth in the appendede claims.

Similar numerals refer to similar parts throughout the drawings.

DESCRIPTION OF THE PREFERRED EMBODIMENT

Figure 1:
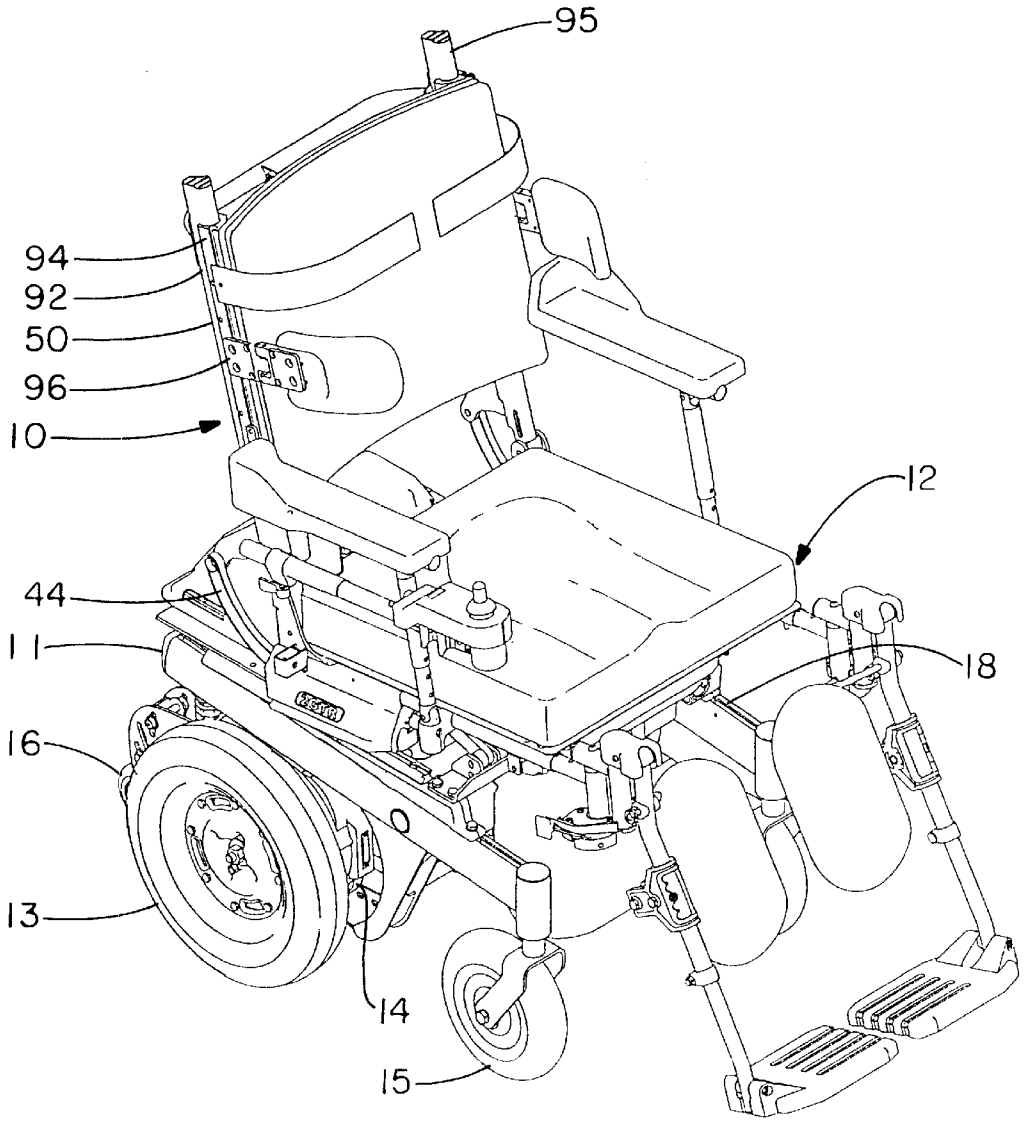
FIG. 1 is a perspective view of one type of wheelchair on which the weight-shifting, reclining seat of the present invention can be utilized.
Figure 2:
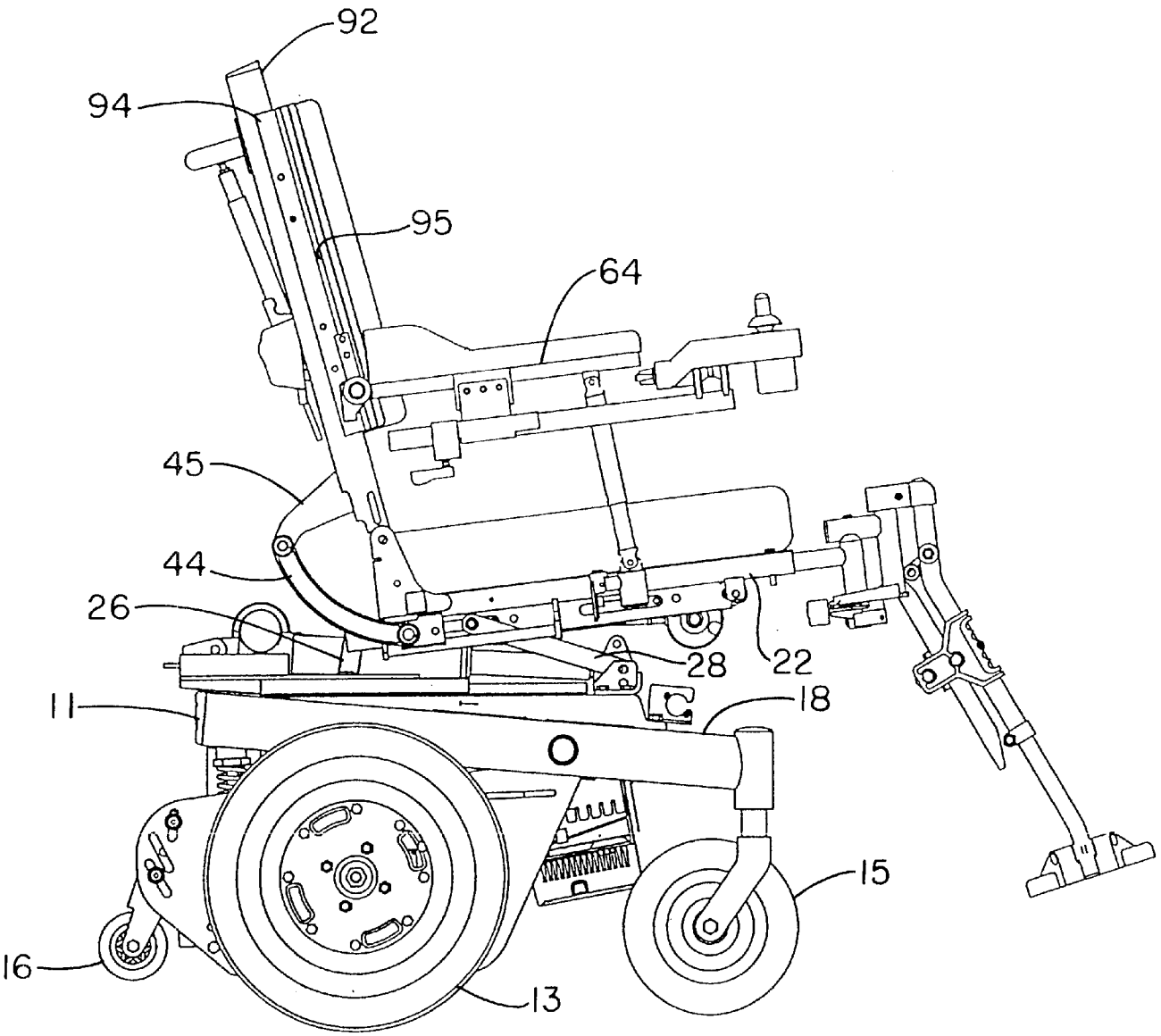
FIG. 2 is a right-elevation view of the wheelchair of FIG. 1.
Figure 3:
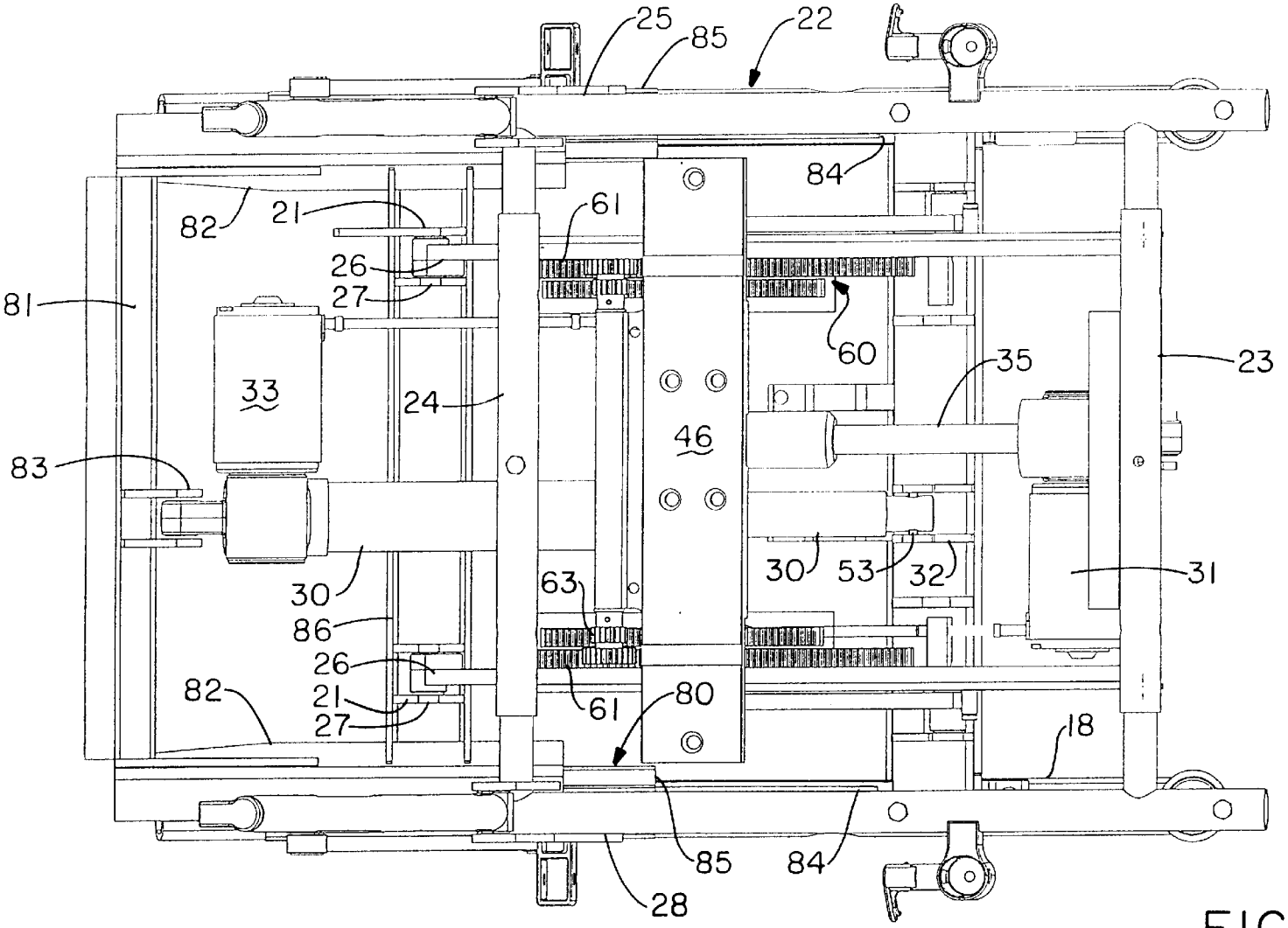
FIG. 3 is an enlarged top plan view of the seat bottom, with hidden parts represented by broken lines, and with the seat bottom upholstery removed, showing the manner of operative connection of the seat bottom to the chair chassis.

It is understood that weight-shifting reclining wheelchair seat of the present invention can be used in other applications or environments besides a wheelchair without affecting the overall concept of the present invention. These other applications or environments include but are not limited to seat recline applications.

The invention is illustrated with a basic power wheelchair 10, which includes a chassis 11 having a pair of drive wheels 13, and a pair of front casters 15, and a pair of rear anti-tip assemblies 16. A carriage frame 18 is supported by the various wheels. The chassis optionally includes intermediate suspension structure. The recline mechanism of the present invention is shown with respect to a power wheelchair having a drive motor 14, but it should be understood that the mechanism could also be used for a manual wheelchair.

The carriage frame 18 includes on either side a pivot assembly 21, which supports a rectangular chair seat frame 22. The seat frame 22 has a front member 23, a rear member 24, and opposing side member 25 which are operatively connected to pivot assembly 21, which comprises pivot links 26 extending upward at pivot points 27 carried on the carriage 18. In accordance with the recline mechanism of the present invention, the seat frame 22 can be longitudinally displaced relative to the pivot assembly 21.

Each drive wheel 13 is powered respectively by one of a pair of motors 14 mounted on chassis 11 adjacent to and operatively connected to its respective drive wheel. A pair of caster wheels 15 each is rotatably and movably mounted on a front end of chassis 11 forwardly of drive wheels 13. A pair of spaced-apart, anti-tip wheels 16, of a type which is well known to those skilled in the wheelchair art, each is movably mounted on a rear end of chassis 11 rearwardly of drive wheels 13. It is understood that wheelchair shown and described to this point commonly is referred to as a rear-wheel drive wheelchair due to the location of the axis of the drive wheels 13 generally behind the center of gravity of the wheelchair when it is occupied and being operated. However, it is further understood that seat 12 could be utilized on what are conventionally referred to as front and mid-wheel drive wheelchairs without affecting the overall concept of the present invention.

As seen in FIGS. 5 through 8, on both sides of the chair, a C-shaped link 44 is connected to the chair canes 40 by means of a rear bracket 45. The other end of the link 44 is pivotally mounted to tie member 46. The seat frame 22 includes an inner-assembly 60 having opposing racks 61, which are united by means of the tie member 46 for controlled forward and rearward engagement by a series of toothed gears 63 (i.e., two on either side). The actuator 35 driven by motor 31 acts by means of the inner assembly 60 to drive tie member 46 forward which both causes recline of the seat back shown in FIGS. 6, 7 and 8, and causes the seat to travel forward to cause weight shift during recline.

Tilt is the action of the seat back and bottom rotating relative to the chassis while maintaining a constant angle between the seat back and bottom. The present invention provides for tilt independently of recline (i.e., the rotation of the seat back relative to the seat bottom). Further, the present invention addresses the change in the center of gravity of a hypothetical user (an individual who is of average height and weight) during repositioning of the seat or seat components.

The tilt mechanism is accomplished using a three-bar linkage where one side has a variable length. Two such linkages are used on either side of the seat frame. Further, one of the links is defined by two members having a fixed angle there between. The first link 28 extends between the seat frame 22 and a laterally extending bracket 32 (including parallel mount plates 34 and a pivot point 29 fixed to the carriage frame 18,) which enables the seat frame member to be slid longitudinally forward in response to the movement of a second linear actuator 30 driven by motor 33 so as to provide the weight-shift feature. The second link is defined by a portion of the seat frame 22 and the rear pivot link 26 which is at a fixed angle relative to the seat frame 22. Pivot link 26 is a member of the pivot assembly 21 also including pivot point 27. The third bar of the linkage includes a linear actuator 30 which provides for a variable length. The actuator 30 is pivotally mounted at one end to the bracket 32 at point 53, and at its other end to a point 83 which is part of a slide assembly 80. The slide assembly 80 further includes a rectangular frame having a rear bar 81 and lateral side members 82 which are carried on rails 84 by means of ball bearing containing mounts 85. A front bar 86 extends from a first mount 85 on a first side member 82 to the opposing mount 85 on the second side member 82. The pivot assembly 21 is carried on the front bar 86. Thus, the third link would extend between the pivot point 53 and the pivot point 83.

The seat back support members or canes 92 are pivotally supported by back brackets 41, which extend at a 90° angle relative to the seat frame at an axis offset from the rear edge of the seat. This hinge connection 42 provides for pivoting of the back canes relative to the seat frame at an axis offset from the rear edge of the seat. This vertical offset (i.e., a distance from the seat base) is meant to provide more anatomically correct pivoting action. Further, the chair is provided with a back-shear assembly 50, which permits readjustment of the chair back rest 51 relative to the chair seat during recline in order to avoid frictional forces to which the user's back would be otherwise subjected, and to help reduce the possibility of back sores which stress and friction could cause.

Figure 4:
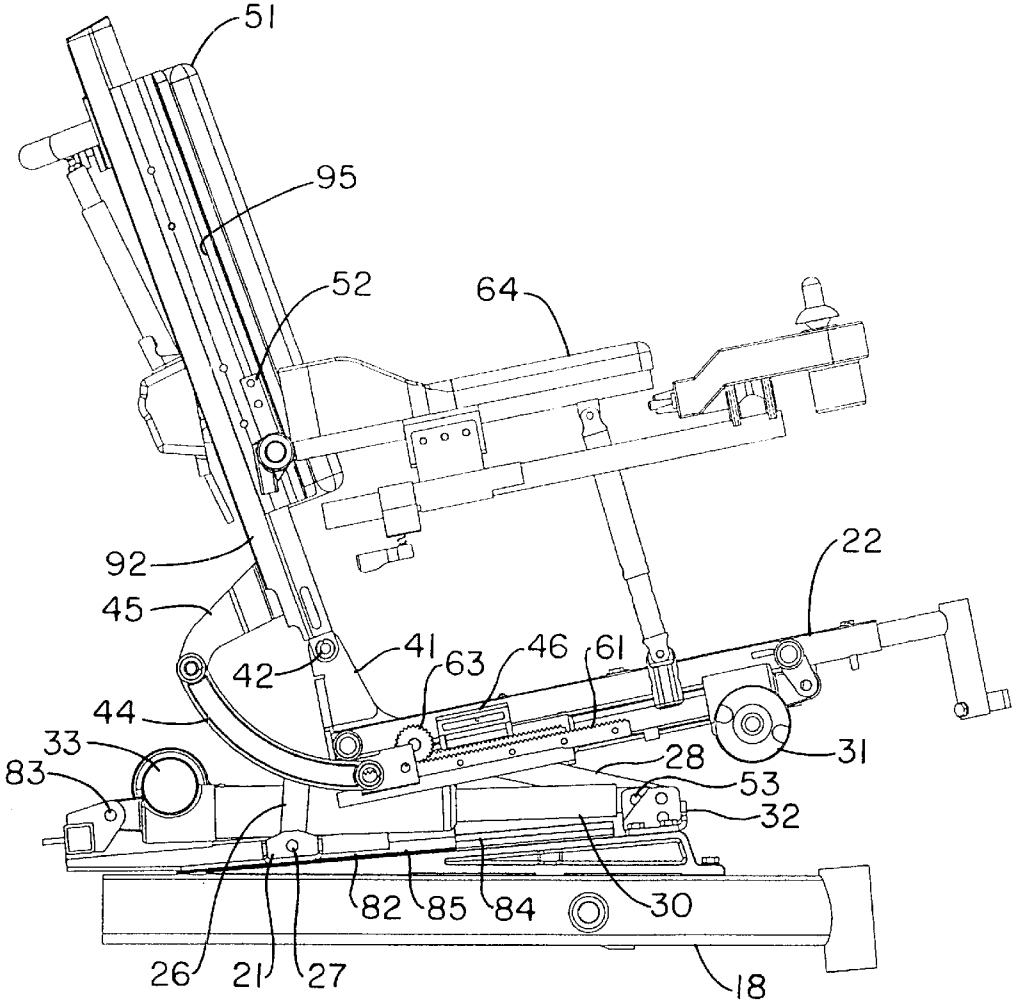
FIG. 4 is a fragmentary right-elevation view of the seat bottom shown in FIG. 3 with portions in section, and further showing a seat back operatively connected to the seat bottom and in a fully upright position.
Figure 5:
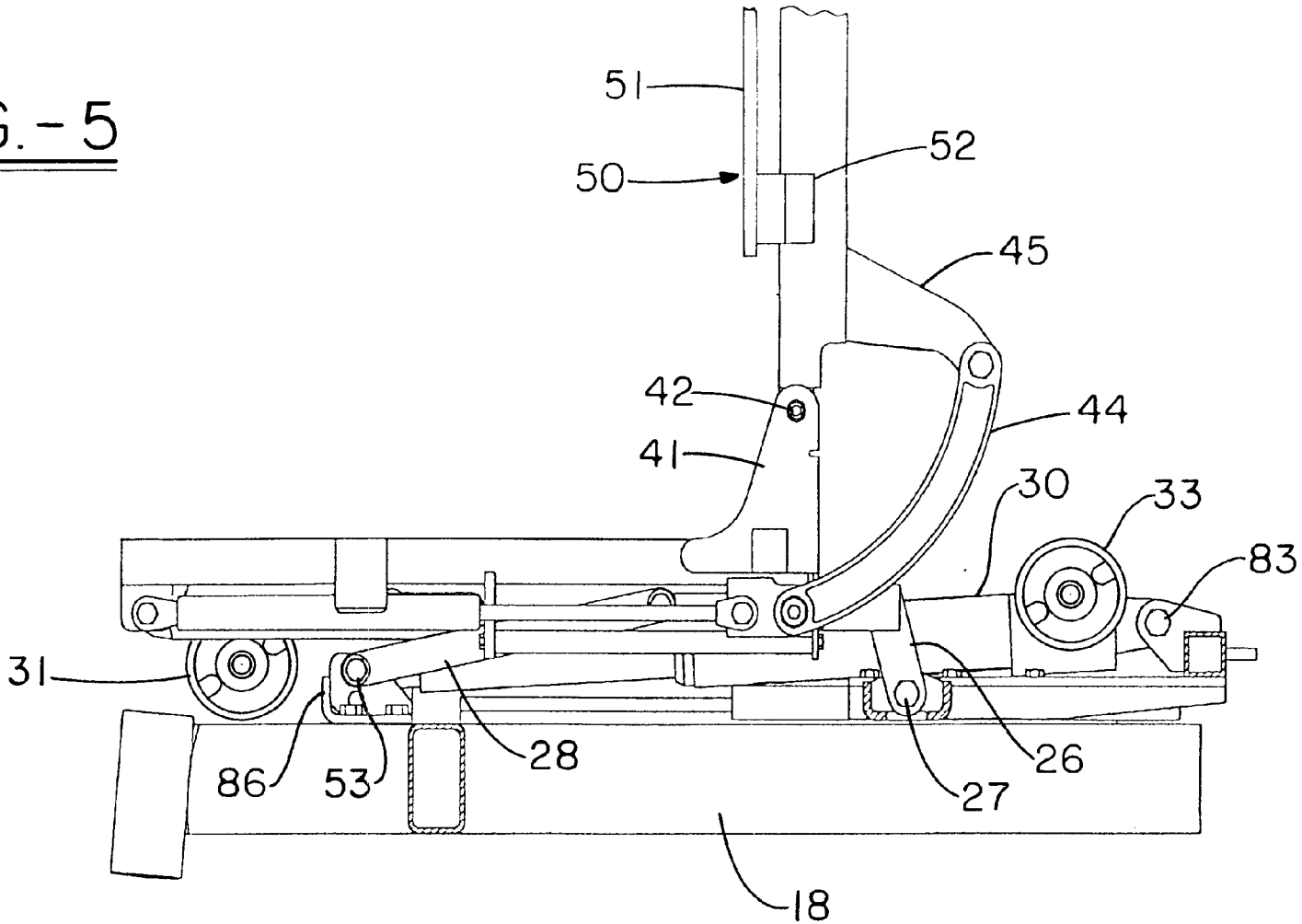
FIG. 5 is an enlarged view similar to FIG. 4 showing the seat back in an initial position.
Figure 6:
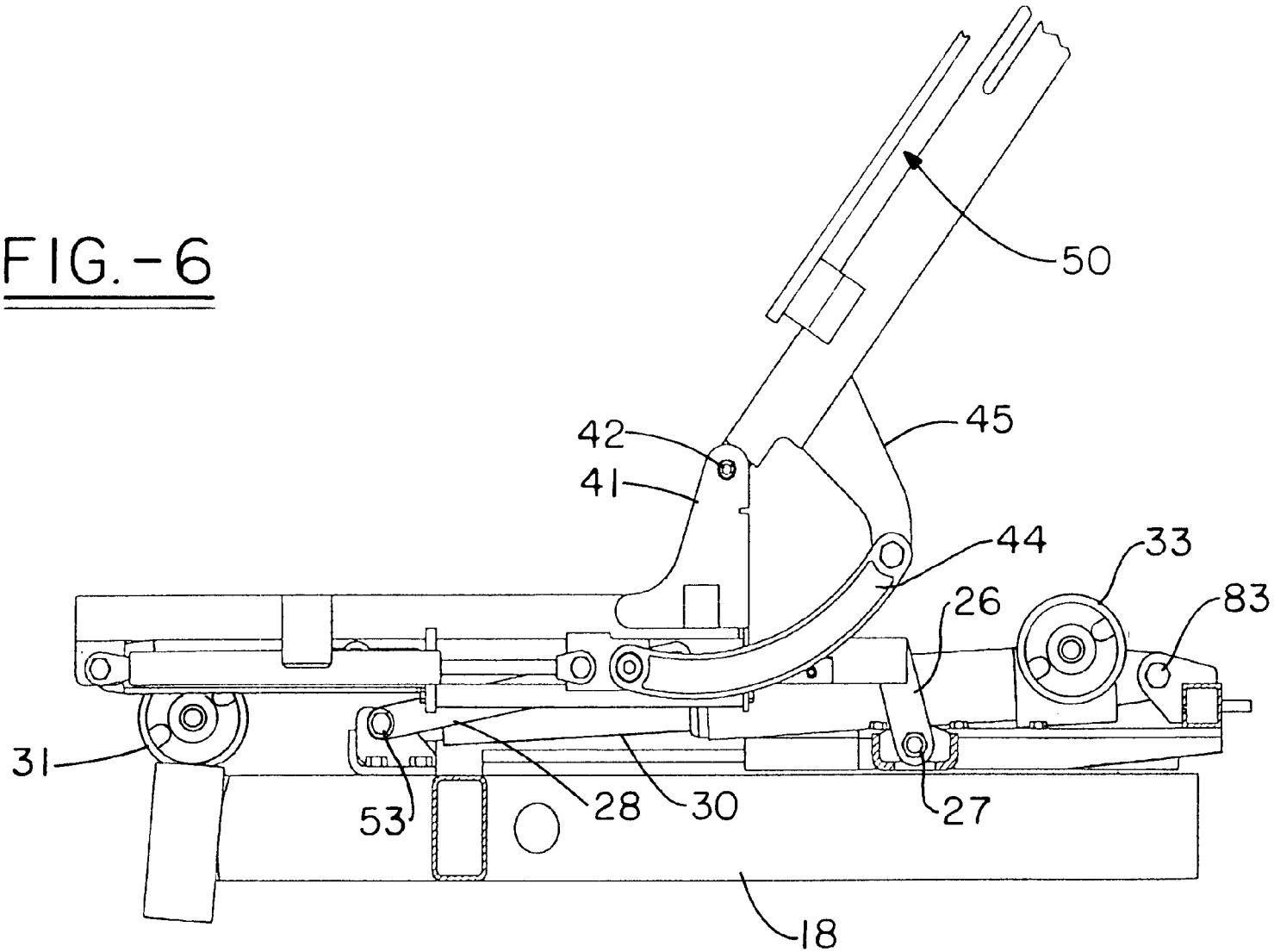
FIG. 6 is a view similar to FIG. 5, but showing the seat back in a first partially reclined position.
Figure 7:
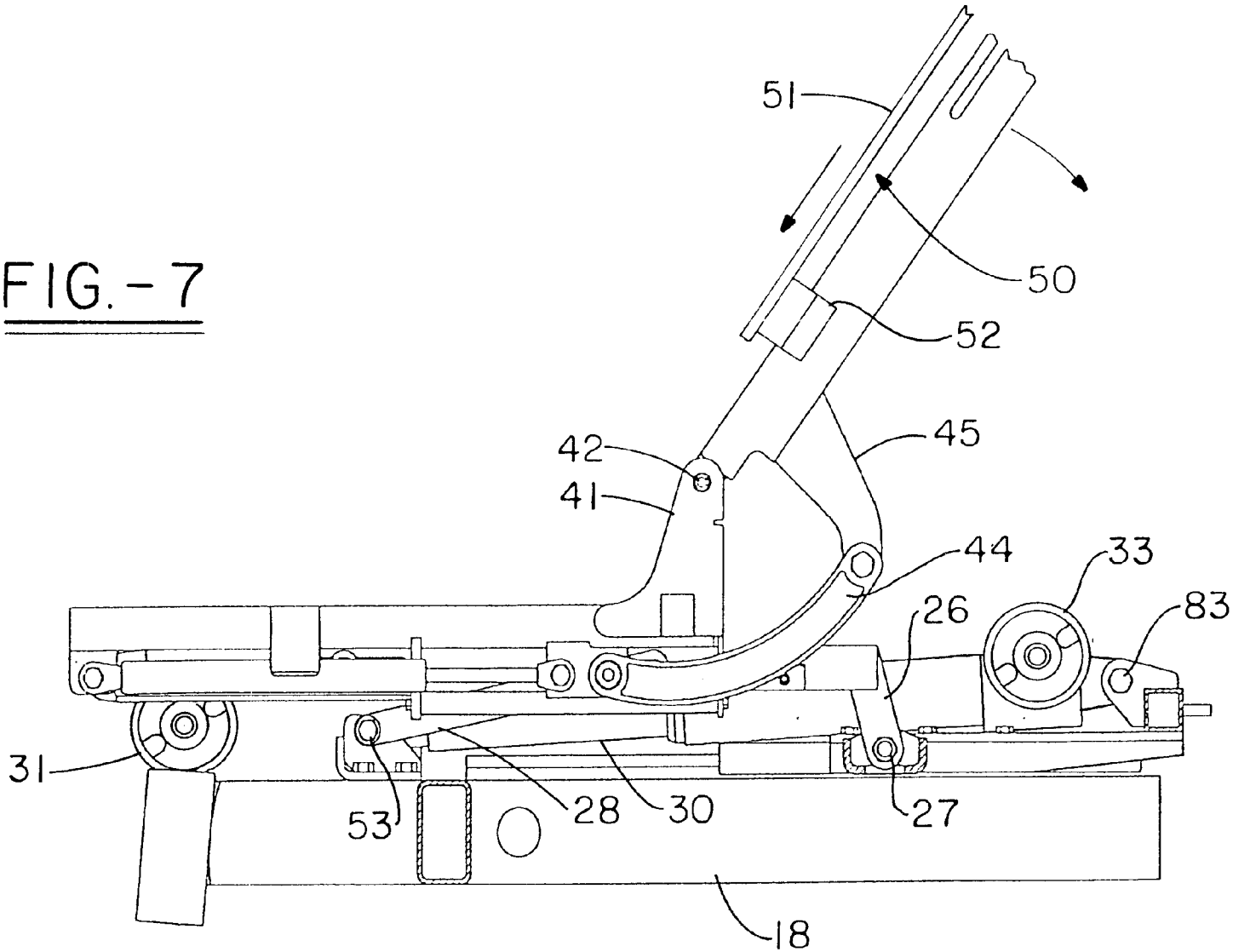
FIG. 7 is a view similar to FIGS. 5 and 6, but showing the seat back in a second partially reclined position.
Figure 8:
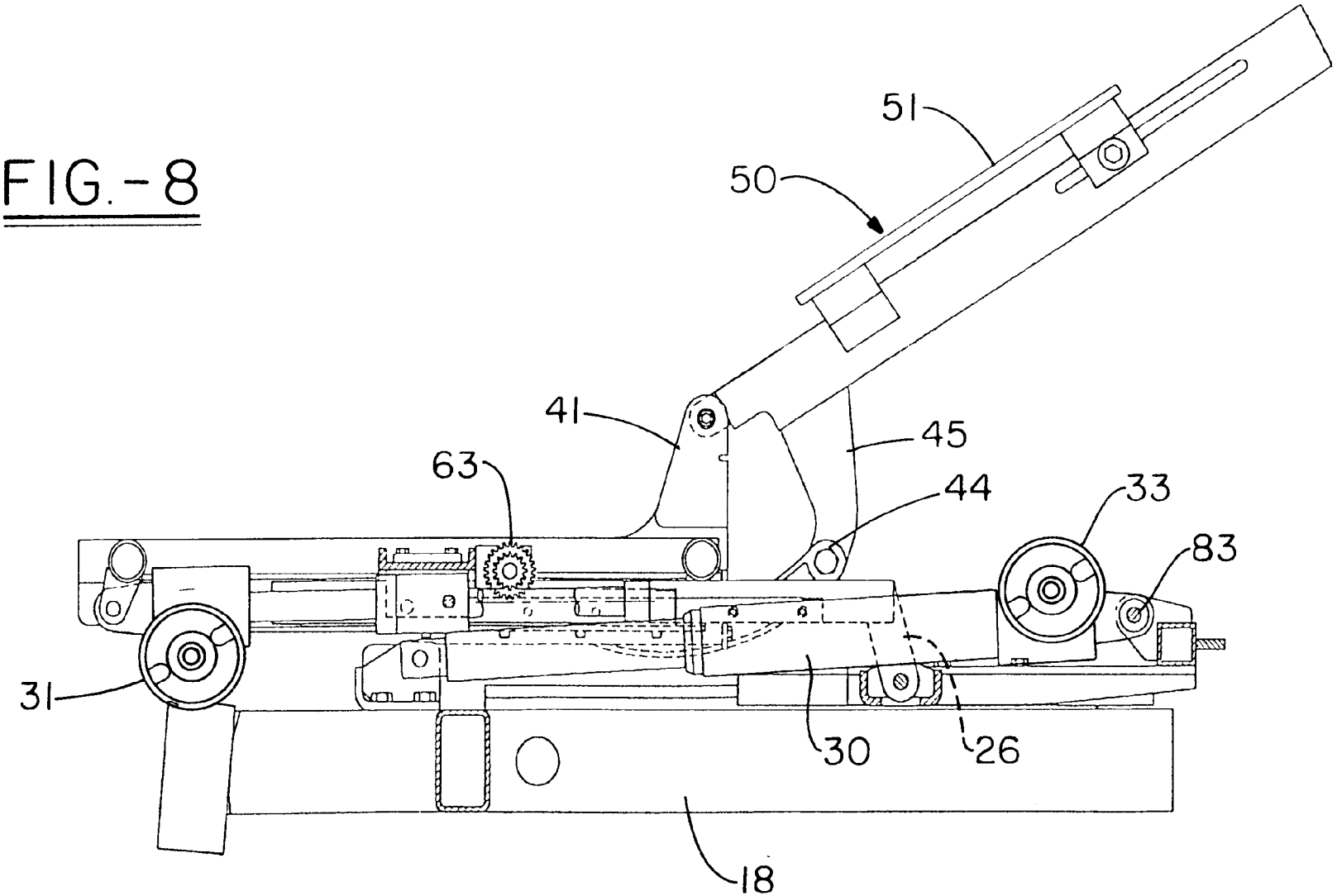
FIG. 8 is a view similar to FIGS. 5 through 7, but showing the seat back in a fully reclined position.
Figure 9:
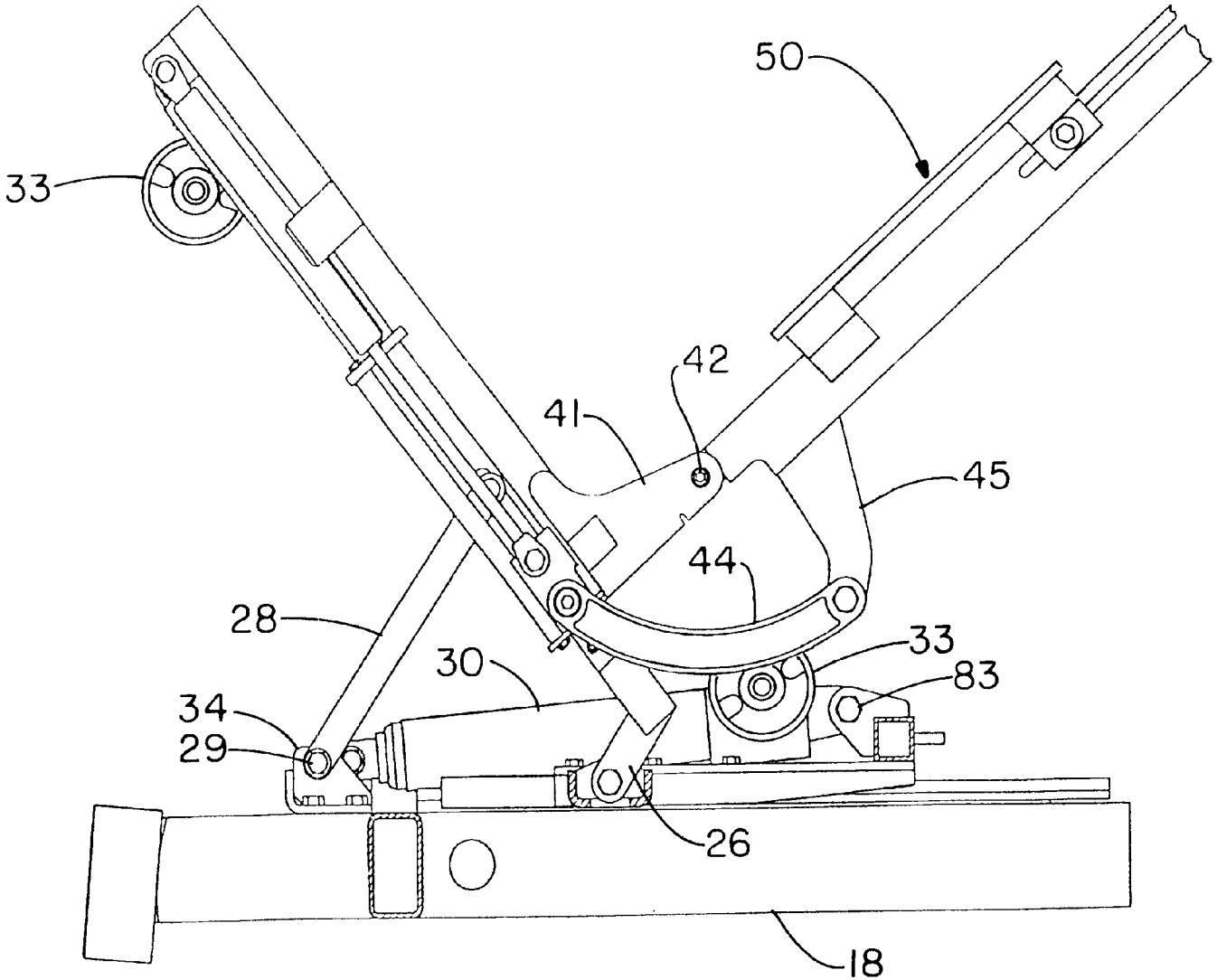
FIG. 9 is a view similar to FIGS. 5 through 7, but showing the manner in which the wheelchair seat of the present invention can be optionally tilted.

In this case, the canes 92 carry a slide mounted 52 (see FIG. 8) back rest 51, which may include a linear actuator (see FIG. 4), such as a ball screw, to actuate the seat back relative to the chair seat. Alternatively, other means of actuator may be used. Thus, as the chair seat is slid longitudinally forward, the seat back may be slid longitudinally downwardly to accommodate the relative change in a person's back relative to the chair back. Further, a microprocessor may be used to control the linear actuator for the back-shear to link the relative position of the back to the seat as it is pushed forward during recline. Alternatively, other mechanical linking means can be used.

The chair further includes arm rest 64 which are pivotally linked to the back and seat bottom to permit repositioning of the arm rests 64 in response to recline.

Further, the back canes 40 are slotted along their longitudinal axis to permit infinite adjustment of rear handles or the like.

Back support 50 comprises a pair of upright lateral supports 92 which include an extension or bracket member 94 having one or more longitudinal slot 95 which will accommodate an accessory such as a lateral stabilizer 96 a push handle, or a ventilation tray.

This provides for infinite vertical adjustment of the accessory relative to the back.

While in accordance with the patent statutes the best mode and preferred embodiment have been set forth, the scope of the invention is not limited thereto, but rather by the scope of the attached claims.

What is claimed is:

1. A wheelchair having a weight-shift tilt mechanism capable of holding a user, and comprising:

a tilt assembly having a seat back and a seat bottom, wherein the seat bottom is rotatable about a substantially horizontal axis on a chair frame and means to cause rotation comprising a cross bar offset from the axis of rotation relative to said seat bottom pivotally connected to a first end of a first linear actuator, and operatively joined at a second end to the axis of rotation;

wherein the seat back of said wheelchair has a second power actuator which is capable of causing a change in angle of the seat back relative to the seat bottom, independently of the first linear actuator.

2. A seat as set forth in claim 1, wherein said seat further includes back-shear structure.

3. A seat as set forth in claim 1, wherein said tie bar includes a toothed gear on the first lateral side and a toothed gear on the second lateral side, and said carriage includes toothed portions which engage said toothed gears.

4. A seat as set forth in claim 1, wherein said seat includes a base member, said carriage having a rear portion pivotally connected to said base member by a first link and a second link being pivotally attached to said frame at a first end and pivotally attached at a second end to said carriage, and a second power actuator extending between said first end of said second link and being pivotally connected to said base member in order to cause tilting of said seat.

5. A wheelchair having wheels which operatively support a seat comprising a seat member and a back member capable of accommodating a user, comprising:

said back member being positionable by a power actuator at a variable angle relative to said seat member and the seat member being displaceable longitudinally forward or backward in response to a change in the angle of the back member by said power actuator relative to the seat member so as to shift the weight of said user relative to said wheels;

said seat member having a bottom side and said power actuator pivotally connected to the bottom side of said seat member, and said back member having a rear side and a link pivotally connected to said rear side of said back member, and said link being connected to said actuator to cause recline;

said seat member being supported on a carriage on a frame and said seat member having a first lateral side and a second lateral side divided by a longitudinal axis extending from front to back of said seat member; said carriage extending across said longitudinal axis, and said power actuator acting on said carriage to transmit movement to both said first and said second lateral side of said seat member; and wherein said carriage is operatively connected to a tie bar extending from the first lateral side to the second lateral side of said seat member and said power actuator is a single linear actuator which acts to move said tie bar.

6. A wheelchair as set forth in claim 2, wherein at least one of said actuators is a ball screw.

7. A wheelchair as set forth in claim 6, wherein said first power actuator is capable of causing a change in angle of the seat back relative to the seat bottom independently of the second power actuator.

8. A wheelchair as set forth in claim 5, wherein said seat member has a bottom side and includes a second actuator pivotally connected to the bottom side of said seat member, and said back member has a rear side and a link is pivotally connected to said rear side of said back member, and said link being connected to said actuator to cause recline.

9. A wheelchair as set forth in claim 5, wherein said tie bar includes a toothed gear on either side, and said carriage includes a toothed portion on the first lateral side and a toothed portion on the second lateral side which engage said toothed gears.

10. A wheelchair as set forth in claim 5, wherein said seat further includes a back-shear structure.

11. A seat, comprising:

a back member, a power actuator, and a seat member, wherein said back member can be reclined relative to the seat member, said back member and said seat member being mounted on a frame, and wherein the seat member is displaced longitudinally relative to the frame in response to the back member being reclined so as to provide weight-shift, said seat member having a bottom side and said power actuator being pivotally connected to the bottom side of said seat member, and said back member having a rear side and a link being pivotally connected to said rear side of said back member, and said link being connected to said power actuator to cause recline;

said seat member being supported on a carriage on said frame and said seat member having a first lateral side and a second lateral side divided by a longitudinal axis extending from front to back of said seat member; said carriage extending across said longitudinal axis and being operatively connected to a tie bar extending from the first lateral side to the second lateral side of said seat member; and said power actuator acting on said tie bar to transmit longitudinal movement to both said first and said second lateral side of said seat member.

12. A wheelchair having wheels which operatively support a seat comprising a seat member and a back member capable of accommodating a user, comprising:

said back member being positionable by a power actuator at a variable angle relative to said seat member and the seat member being displaceable longitudinally forward or backward in response to a change in the angle of the back member by said power actuator relative to the seat member so as to shift the weight of said user relative to said wheels; and wherein said seat includes a base member, said seat member having a rear portion pivotally connected to said base member by a first link and a second link being pivotally attached to a frame at a first end and pivotally attached at a second end to said seat member, a second power actuator extending between said first end of said second link and being pivotally connected to said base member in order to cause tilting of said seat.

* * * * *